US006010341A

United States Patent [19]

Matsuoka

[11] Patent Number: 6,010,341

[45] **Date of Patent: *Jan. 4, 2000**

[54] ELECTRICAL CONNECTION UNIT WITH A JUNCTION BLOCK OR MAIN BOX HAVING AN EXTENDED SIDE WALL

[75] Inventor: Hideo Matsuoka, Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/199,863

[22] Filed: Nov. 25, 1998

[30] Foreign Application Priority Data

Nov. 25, 1997 [JP] Japan ..... 9-323166

[51] Int. Cl.[7] ..... H01R 9/09

[52] U.S. Cl. ..... 439/76.2; 439/949; 439/364

[58] Field of Search ..... 439/76.2, 949, 439/467, 658, 364

[56] References Cited

U.S. PATENT DOCUMENTS

| | | | |
|---|---|---|---|
| 4,940,419 | 7/1990 | Kurita et al. | 439/76.2 |
| 4,954,102 | 9/1990 | Ozaki et al. | 439/535 |
| 5,315,062 | 5/1994 | Hoshino | 439/467 |
| 5,444,182 | 8/1995 | Hoshino | 439/467 |
| 5,788,529 | 8/1998 | Borzi et al. | 439/76.2 |

FOREIGN PATENT DOCUMENTS

| | | |
|---|---|---|
| 0248181 | 4/1987 | European Pat. Off. . |
| 9007814 | 12/1990 | WIPO . |

OTHER PUBLICATIONS

European Search Report EP 98 12 2384 dated Feb. 99.

*Primary Examiner*—Steven L. Stephan
*Assistant Examiner*—T C Patel
*Attorney, Agent, or Firm*—Jordan B. Bierman; Bierman, Muserlian and Lucas

[57] ABSTRACT

An electrical connection unit having a junction block and a plurality of connectors mounted thereon. The junction block carries a plurality of electrical elements, also mounted thereon and in electrical contact with the elements. There is a plurality of wire harnesses extending from the connectors and the side walls of either the junction block or a main box are extended beyond the connectors in a direction away from the elements. The remote edges of the side walls bear against the vehicle body and provide a space between the edges and the connectors. This construction provides a space through which the wire harnesses can be passed and a simple means of waterproofing without the necessity of a bottom cover. In addition, the pull-out section is composed of two semi-cylinders, which are hinged to each other so that the wire harnesses can be placed therein and one of the semi-cylinders rotated about the hinge, closed, and latched.

5 Claims, 6 Drawing Sheets

ELECTRICAL CONNECTION UNIT WITH A JUNCTION BLOCK OR MAIN BOX HAVING AN EXTENDED SIDE WALL

This Application claims the benefit of the priority of Japanese 9-323166, filed Nov. 25, 1997.

The present Invention is directed to an electrical connection unit which contains a junction block and optionally a main box. The unit is primarily intended for mounting in the engine compartment of a vehicle and to provide power to various electrical elements contained therein or used therewith.

BACKGROUND OF THE INVENTION

A typical prior art unit of the same general type as claimed herein comprises a connector with a wire harness extending therefrom. The connector is directly assembled with a junction block on which electrical parts such as fuses or relays are mounted. It is also known to have such a unit wherein the junction block is mounted in a main box and the connector is mounted in the junction block.

A cover is attached to the lower end of a side wall of the block or main box which seals the lower end thereof and provides desired waterproofing. Also, a plurality of legs may be provided on the lower portion of the side wall of the junction block or main box which permits the block or box to be spaced apart from the portion of the vehicle body to which it is attached. However, the need to have a cover or a plurality of legs in order to mount the unit properly is a drawback. The structure becomes more complex and installation more difficult. It is, therefore, an object of the present invention, to achieve the desired waterproofing of the unit and spacing from the vehicle body without the need for such expedients.

BRIEF DESCRIPTION OF THE INVENTION

To solve the foregoing problems, there is provided an electrical connection unit, adapted to be mounted on a portion of a vehicle body, which includes a junction block and a plurality of connectors. The junction block carries a plurality of electrical elements and the connectors are mounted in or on the block and in electrical contact with the elements. Side walls of the junction block extend beyond the connectors in a direction away from the elements and the edges thereof are adapted to bear against a portion of a vehicle body. The extended walls provide a space between the connectors and the vehicle body in which a plurality of wire harnesses pass and extend outside the connection unit.

The extended side walls may be contiguous with corresponding walls of the junction block. Alternatively, the connectors may be in the main box and the junction box affixed thereto. The side walls would, in this case, extend from the main box.

In a preferred form of the device, at least one pull-out section is provided on the extended portion of the side walls and the wire harnesses pass therethrough. It has been found particularly advantageous if the pull-out section comprises first and second semi-cylinders which are complementary to each other. They are connected at one edge by a hinge, whereby the second semi-cylinder pivots about the hinge into contact with the first semi-cylinder, thereby retaining the wire harness in the pull-out section.

It has been found particularly desirable to provide a female latch on one of the two semi-cylinders and a complementary male latch on the other semi-cylinder. By this means, the two semi-cylinders are retained together, thereby forming a complete cylinder and holding the wire harnesses therein.

BRIEF DESCRIPTION OF THE DRAWINGS

In the accompanying drawings, constituting a part hereof, and in which like reference characters constitute like parts.

DETAILED DESCRIPTION OF THE INVENTION

Figure 2:
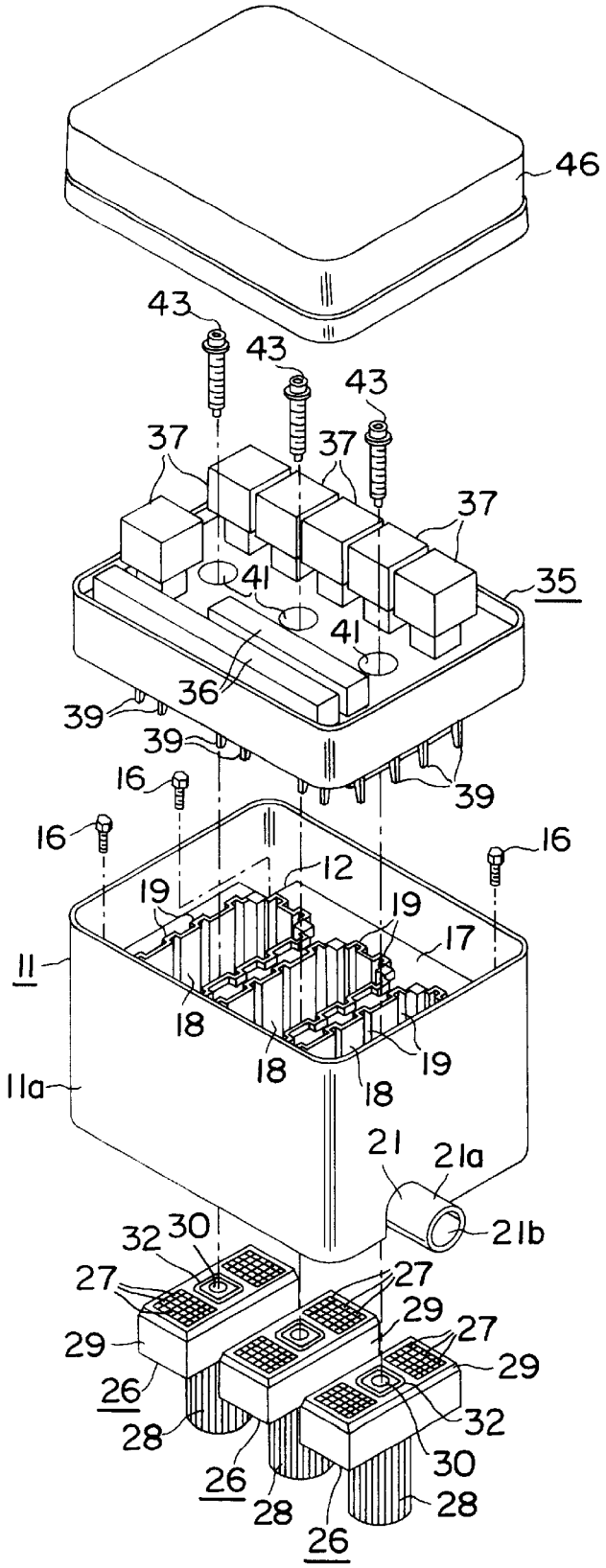
FIG. 2 is an exploded perspective view of the Invention.
Figure 3:
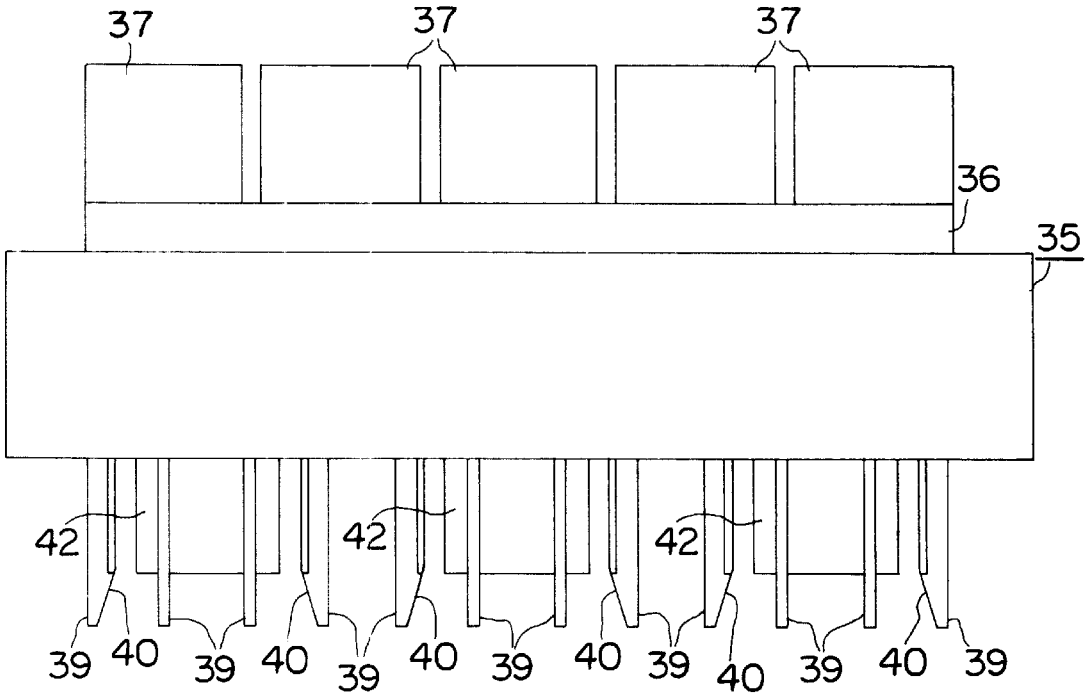
FIG. 3 is a front view of the junction block.
Figure 4:
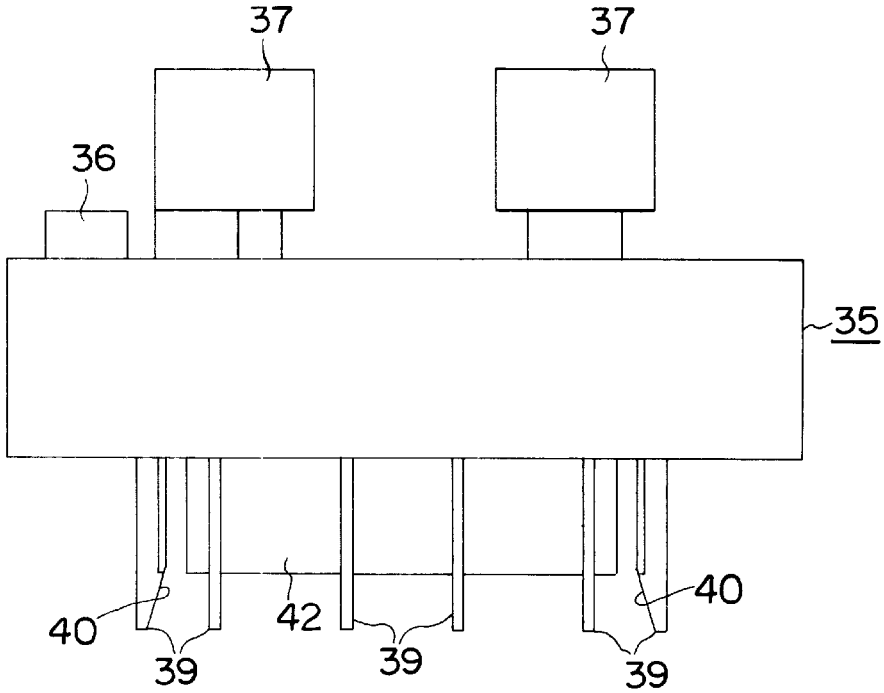
FIG. 4 is a side view of the junction block of FIG. 3.
Figure 5:
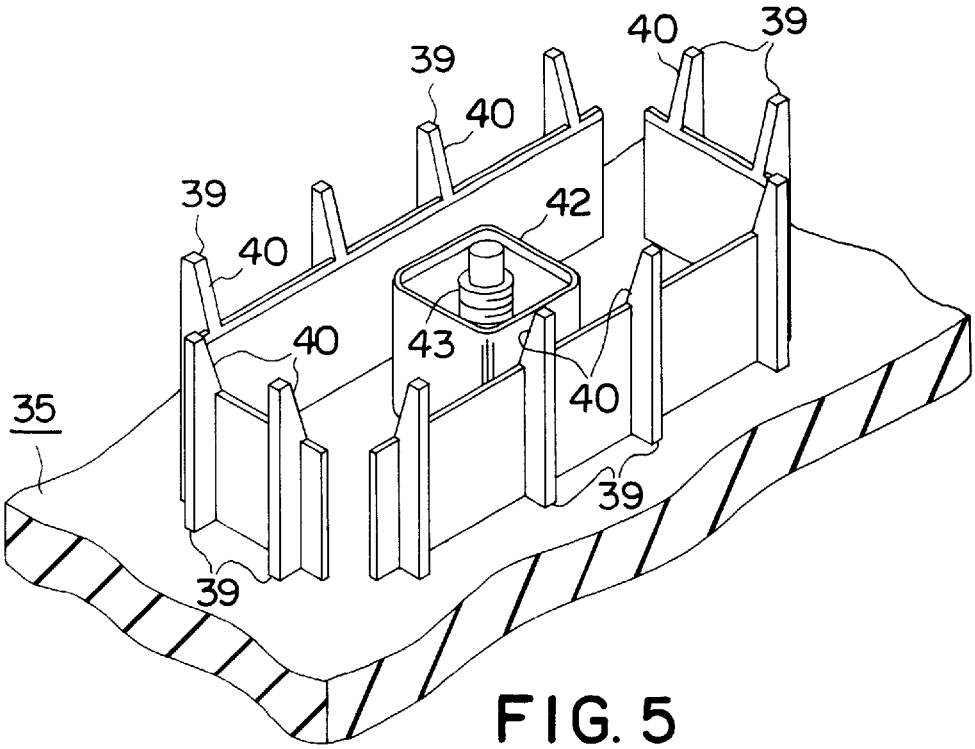
FIG. 5 is a schematic perspective view of the underside of the junction block of FIG. 3.
Figure 6:
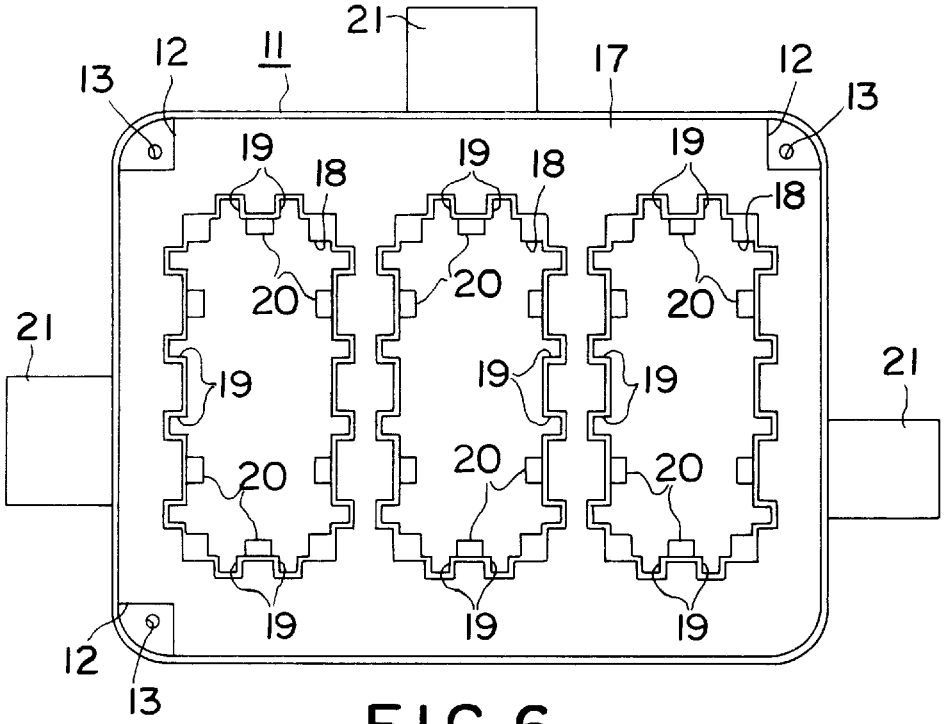
FIG. 6 is a plan view of the main box.

The inventive connection unit comprises cover 46, junction block 35 and main box 11. Junction block 35 contains, for example, fuses 36 and relays 37. It is attached to main box 11 by fastening bolts 43. Projections 39 on the underside of junction block 35 fit into cavity grooves 19 and thereby guide junction block 35 into main box 11. Connectors 26 with female contacts 27 are inserted into main box 11 from the lower end as shown in FIG. 2. Retainers 32 with insertion holes 30 are located on female contacts 27 so that fastening bolts 43, passing through bolt openings 41, engage nut 31 and secure junction block 35 to main box 11.

Figure 1:
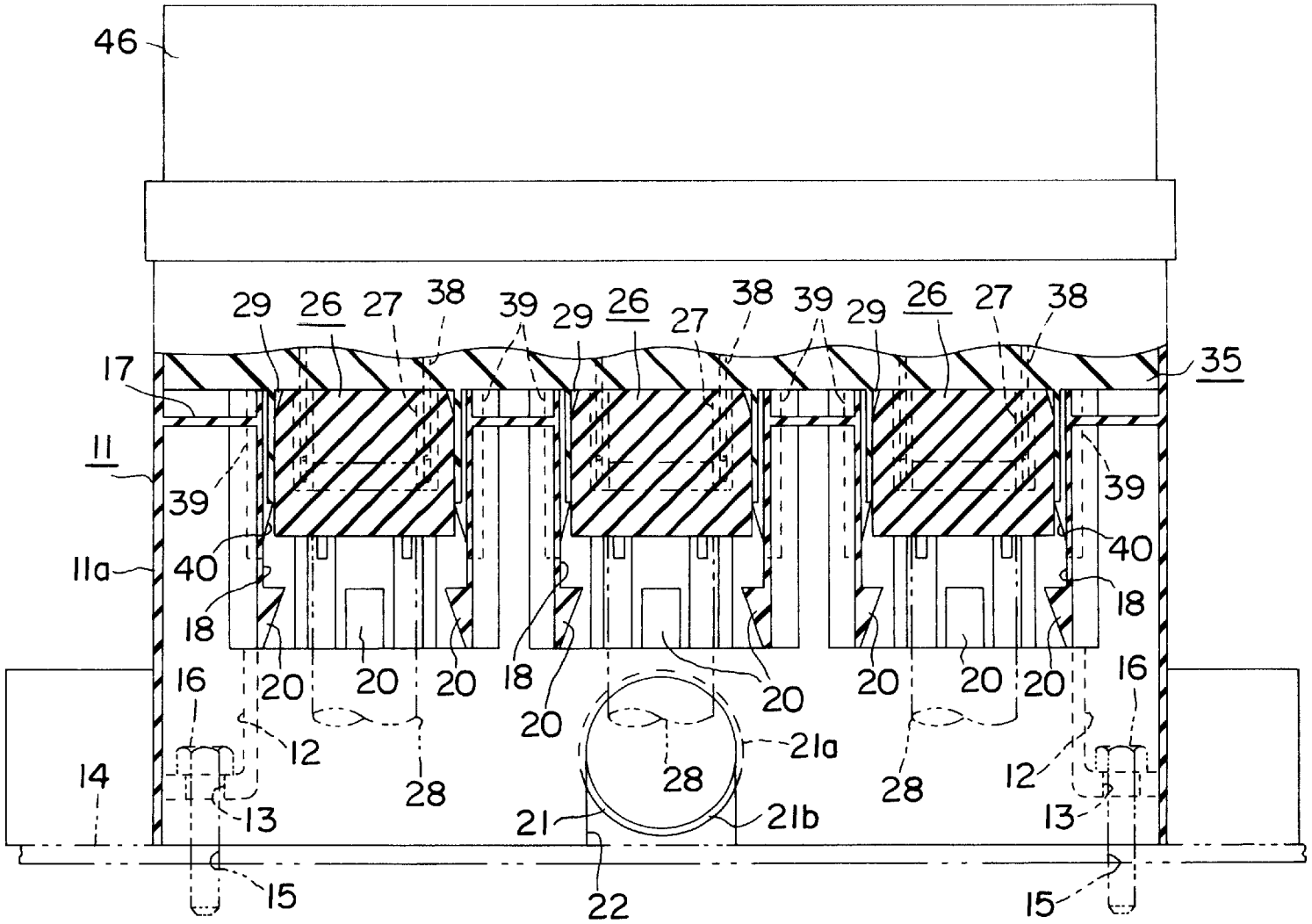
FIG. 1 is a schematic cross section of the electrical connection unit of the present Invention.

Side walls 11*a* extend downwardly, as shown in FIGS. 1 and 2, and bear against vehicle body 14. Securing bolts 16, passing through screw holes 15, serve to fix the electrical connection unit to the vehicle body.

Support plate 17 is at the center portion of main box 11 and connector cavities 18 are at predetermined intervals on the support plate. Claws 20 are located at the lower ends of connector cavities 18 and serve as support members. Harness opening 22 opens downward from the bottom end of side wall 11*a* of main box 11. First semi-cylinder 21*a* is integral with the upper edge of harness opening 22 and extends outward from the main box. Second semi-cylinder 21*b* is connected at one edge to first semi-cylinder 21*a* by hinge 23. Thus, second semi-cylinder 21*b* has an open position, as shown in full lines in FIG. 8, and a closed position, as shown in broken lines in FIG. 8. The edges of both semi-cylinders remote from hinge 23 are provided with female latch 24 and male latch 25. As can be seen best in FIG. 8, when second semi-cylinder 21*b* is in its closed position, female latch 24 mates with male latch 25, whereby wire harness 28 (see FIGS. 1 and 7) is secured in pull-out section 21.

Figure 7C:
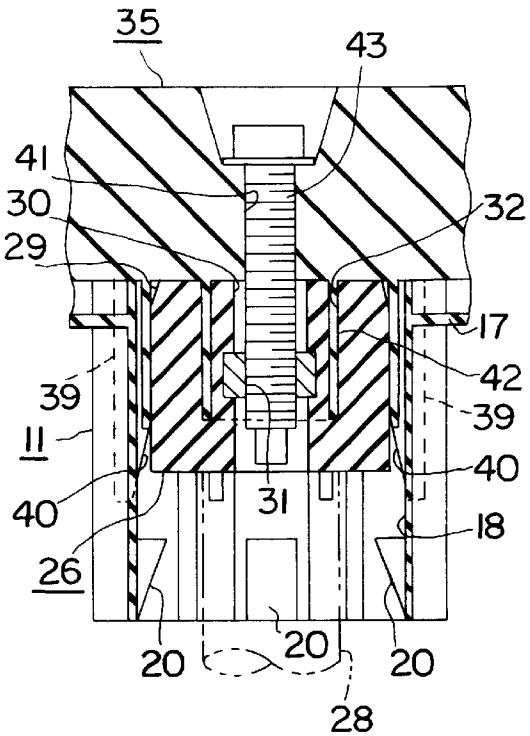
FIGS. 7 are fragmentary cross sections showing, in (*a*), (*b*), sequence, the assembly of the connection unit and (*c*) of the present Invention.
Figure 7B:
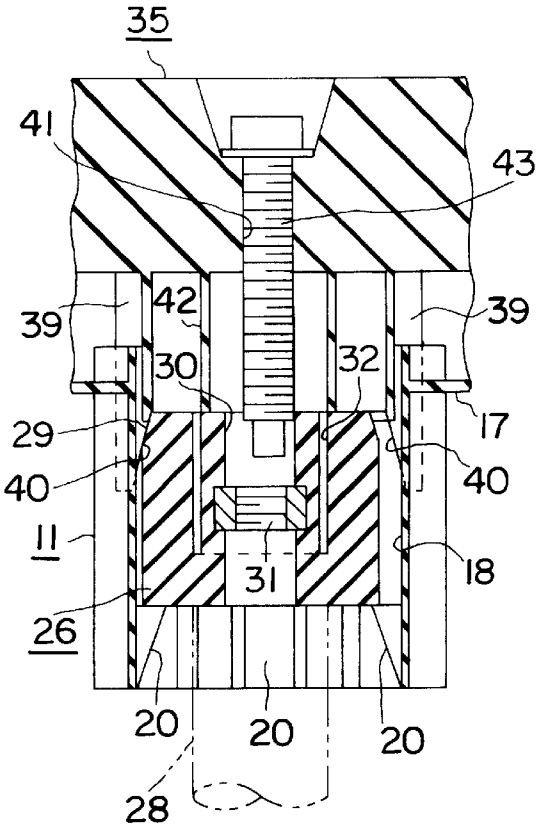
Figure 7A:
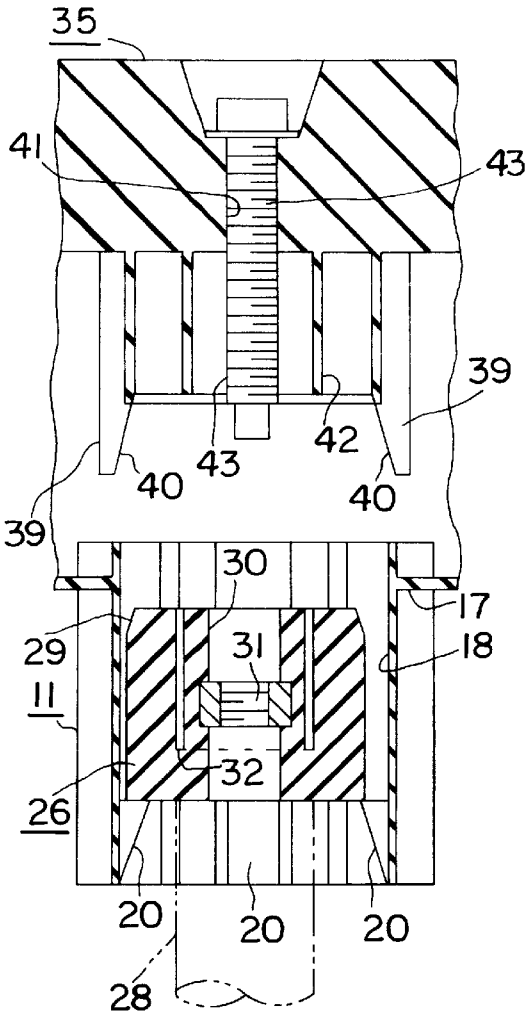
Figure 8:
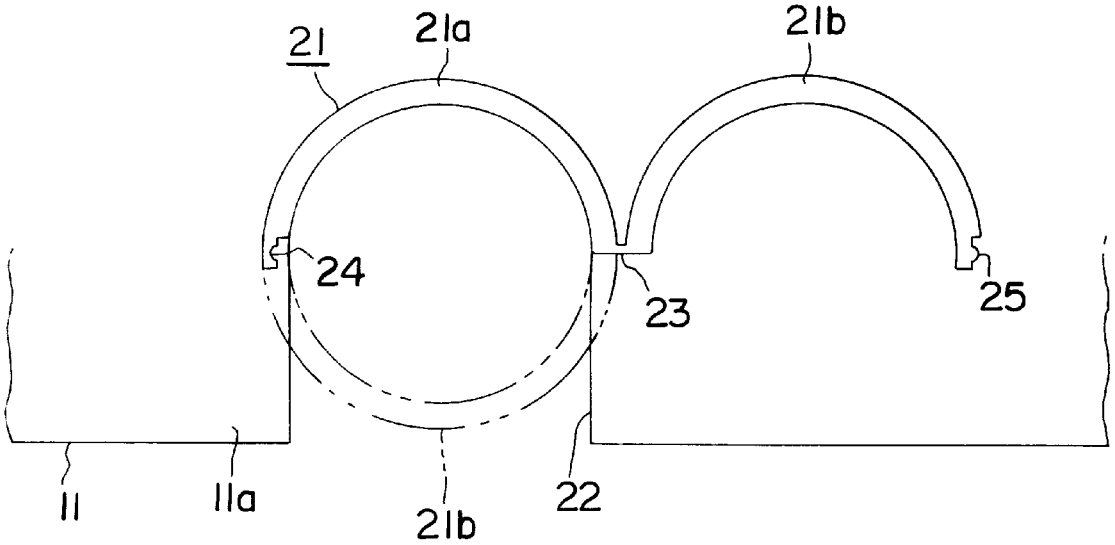
FIG. 8 is an enlarged schematic end view of the pull-out section.

Referring more specifically to FIGS. 1, 2, and 7, connectors 26 are inserted into connector cavities 18 of main box 11 from below. They fit loosely in these cavities and are supported by claws 20 in the preliminary position as shown in FIG. 7(*a*). Each wire harness 28 is connected to female contacts 27, extends from the lower portion of connectors 26, is passed through harness opening 22, and is secured in pull-out section 21 by first semi-cylinder 21*a* and second semi-cylinder 21*b*.

Tapered surfaces 29 are on the upper outer edges of connectors 26. Insertion hole 30 is located vertically at the center of connector 26 and nut 31 is imbedded therein within retainer 32. The retainer prevents nut 31 from turning when fastening bolt 43 is inserted and tightened.

As is best shown in FIGS. 1 to 5 and 7, junction block 35 is mounted inside main box 11 from above as shown in FIG. 2. Fuses 36 and relays 37 are mounted on the upper surface of junction block 35 and a plurality of male contacts 38, connected to these electrical parts, is mounted on the lower surface. There is also provided a plurality of projections 39, in three groups in the present case, which extend from the lower surface of junction block 35 and surround male contacts 38.

When junction block 35 is mounted in main box 11, projections 39 are inserted into and engaged in cavity grooves 19 in connector cavities 18. Slanted surfaces 40, at the lower inner perimeter edge of projections 39, bear against tapered surfaces 29, as junction block 35 enters main box 11 (see particularly FIGS. 7(*b*) and (*c*)). Engagement elements 42, in the form of four-sided rings, surround bolt openings 41 in junction block 35. Bolts 43, which serve as tightening means, are inserted into bolt openings 41 and are screwed into nuts 31 within connectors 26.

As shown in FIG. 7(*c*), junction block 35 is urged against connectors 26 and male contacts 38 are firmly connected to female contacts 27 when bolts 43 are fully tightened. Elements 42 engage retainers 32 of connectors 26, thus further securing junction block 35 in its assembled position. As shown in FIGS. 1 and 2, cover 46 is placed over the upper end of main box 11.

The assembly of the electrical connection unit of the present Invention is shown in FIGS. 7(*a*), (*b*), and (*c*). In this portion of the description, reference will be made to a single connector, but it is understood that each of the plurality of connectors is assembled in the same way. Connector 26 is inserted into connector cavity 18 of main box 11 from below. Claws 20 loosely support connector 26 at a preliminary position. Wire harness 28, extending from connector 26, is passed through harness opening 22 which carries first semi-cylinder 21*a* at its upper end. At this point, second semi-cylinder 21*b* is pivoted about hinge 23 from the position as shown in solid lines in FIG. 8 to the position shown in broken lines in FIG. 8. Female latch 24 and male latch 25 are engaged to secure wire harness 28 in pull-out section 21.

The lower (as shown in FIG. 2) edge of side wall 11*a* is fixed to body 14 of the vehicle. This is accomplished by securing bolts 16, passing through bolt hole 13 (in main box 11) and screw hole 15 (in vehicle body 14). Thereafter, as shown in FIG. 7(*b*), junction block 35 is inserted into main box 11 from above. Projections 39 are inserted into and engage cavity grooves 19 in connector cavity 18, thereby aligning junction block 35 in main box 11.

As junction block 35 is mounted, slanted surface 40 engages tapered surface 29. As a result, connector 26, which was loosely held in connector cavity 18, is both centered and moved to its connection position (see particularly FIG. 7(*b*)). Fastening bolts 43 are passed through bolt openings 41 from above and are screwed into nuts 31, as shown in FIG. 7(*c*). Engagement element 42 engages retainer 32, and fastening bolt 43 is screwed into nut 32 of connector 26. This moves connector 26 upwardly from claws 20 and causes female contact 27 to make firm electrical contact with male contact 38. The final step is to place cover 46 over the upper surface of junction block 35. The assembly of the unit is now complete.

By means of the foregoing construction, a simplified waterproof connection unit can be provided, without the necessity of a bottom cover or the use of a plurality of legs bearing against the vehicle body. In addition, the wire harness can easily be passed through the space created by the extended side walls, led out through the harness opening, and secured by the pull-out section.

The construction of the pull-out section permits wide opening of the semi-cylinders by pivoting the second semi-cylinder about the hinge in a direction away from the first semi-cylinder. When in this open position, it is an easy matter to lay the wire harness in the first semi-cylinder and, thereafter, pivot the second semi-cylinder about the hinge toward the first semi-cylinder. This closes the pull-out section and the male and female latches engage so as to secure it in this closed position. This provides a reliable means of locking the wire harness in its proper position.

Although only a limited number of specific modifications of the present Invention have been expressly disclosed, such changes as would be apparent to the person of ordinary skill may be made without departing from the scope or spirit thereof. For example, it is not always necessary to provide the main box; the junction block may be so designed that the connectors are mounted directly therein, thus eliminating the main box entirely. In such a case, it is the side wall of the junction block which will be extended in the direction away from the electrical elements to bear against—and be affixed to—the vehicle body, especially the inside of the engine compartment.

In assembling the device, it is not necessary that the main box be affixed to the vehicle body before the junction block is inserted on the contrary, it is feasible to connect the junction block and the main box first, and then secure the whole to the vehicle.

Although only a single embodiment of the present Invention has been disclosed in detail, the Invention is, nonetheless, to be broadly construed, and not to be limited except by the character of the claims appended hereto.

What we claim is:

1. An electrical connection unit, adapted for affixation to a vehicle body portion, said unit comprising a junction block and a plurality of connectors, said junction block carrying a plurality of electrical elements, said connectors being mounted on said junction block and in electrical contact with said elements, a plurality of wire harnesses extending from said connectors, side walls, contiguous with corresponding walls of said junction block, extending beyond said connectors in a direction away from said elements to create a space between said connectors and edges of said side walls remote from said elements, said edges adapted to seal against said portion of said vehicle body, a main box having a bottom adjacent said edges and a top remote from said bottom, said connectors being in said electrical connection unit, said junction box affixed to said main box, said side walls being extensions of said main box, connector cavities, into which said connectors fit, in said main box and mounted on a support plate which is affixed to said main box between said top and said bottom, said support plate being closer to said top than said bottom whereby there is an open space adjacent said bottom adapted to receive portions of said wire harness, said bottom being open.

2. The electrical connection unit of claim 1 wherein there is at least one pull-out section through which said wire harnesses pass, said pull-out section projecting from one of said side walls.

3. The electrical connection unit of claim 2 wherein said pull-out section is between said space and an exterior of said connection unit.

4. The electrical connection unit of claim 2 wherein said pull-out section comprises a first semi-cylinder and a second semi-cylinder complementary to said first semi-cylinder, said second semi-cylinder being connected to said first semi-cylinder by a hinge, whereby said second semi-cylinder can move between a first position, wherein said first semi-cylinder is open to receive said wire harness, and a second position, wherein said second semi-cylinder closes over said first semi-cylinder, thereby retaining said wire harness in said pull-out section.

5. The electrical connection unit of claim 4 wherein there is a female latch on an edge, remote from said hinge, of one of said first semi-cylinder and said second semi-cylinder, and a male latch, complementary to said female latch, on an edge, remote from said hinge, of the other of said first semi-cylinder and said second semi-cylinder, whereby said male latch and said female latch releasably retain said pull-out section in said second position.

* * * * *